US005496135A

United States Patent [19]

Penix

[11] Patent Number: 5,496,135

[45] Date of Patent: Mar. 5, 1996

[54] ARTICULATED VEHICLE FOR USE IN CONFINING TRENCH WORK

[75] Inventor: C. Wayne Penix, Watauga, Tenn.

[73] Assignees: C. Darrin Godsey; Clyde Godsey, both of Johnson City, Tenn.

[21] Appl. No.: 203,427

[22] Filed: Mar. 1, 1994

[51] Int. Cl.[6] ..... E02F 5/10

[52] U.S. Cl. ..... 405/179; 405/180; 37/142.5; 172/817

[58] Field of Search ..... 405/179, 180, 405/181; 37/231, 347, 352, 355, 142.5; 172/292, 817–821, 252, 797; 280/474, 455.1

[56] References Cited

U.S. PATENT DOCUMENTS

| | | | |
|---|---|---|---|
| 3,771,241 | 11/1973 | Lindell et al. | 37/352 |
| 4,362,435 | 12/1982 | Henry | 405/179 |
| 4,833,797 | 5/1989 | Slunecka et al. | 37/352 |
| 4,981,396 | 1/1991 | Albertson et al. | 405/179 |

FOREIGN PATENT DOCUMENTS

| | | | |
|---|---|---|---|
| 0245578 | 6/1963 | Australia | 37/142.5 |

*Primary Examiner*—Ramon S. Britts
*Assistant Examiner*—Frederick L. Lagman

[57] ABSTRACT

A powered, wheeled vehicle for preparing a trough in crushed stone or similar material layed in a trench, and for covering over a field line drain pipe positioned in the trough with the material previously displaced therefrom, said vehicle comprising a body having a rear section and a front section pivotally connected for body articulation together in a substantially horizontal plane, a stanchion having a vertical position axis and a longitudinal axis, is mounted on the body by cooperating pivot elements on the stanchion and on an outer end portion of the front section, the pivot elements allowing the stanchion to be maintained in a generally upright posture on the front section while providing angular adjustability to the stanchion, the adjustability consisting of individual rotational and tilting paths of motion with respect to the vertical position axis, the stanchion further having a work shaft to which any of the implement means can be affixed, and cooperating elements of a first bearing on the work shaft and on the stanchion for allowing the work shaft to move substantially longitudinally of the stanchion in a generally up or down direction to provide a parallel path of motion with respect to the longitudinal axis for any implement affixed to the work shaft, the first bearing directing the work shaft and any implement affixed thereto to move coincidentally with the stanchion through each of the rotational or tilting paths of motion, first power device for selectively moving the work shaft in a generally up or down direction for providing the parallel path of motion to the implement, second power device engaging the stanchion for selectively rotating the same in either direction about the vertical position axis to provide the rotational path of motion, and third power devices engaging the stanchion for selectively rotating the same in either direction about the pivot axis to provide the tilting path of motion, a coupling device on the work shaft for removably affixing an implement means thereto, and individual control means on the vehicle for selectively actuating each of the power devices.

9 Claims, 5 Drawing Sheets

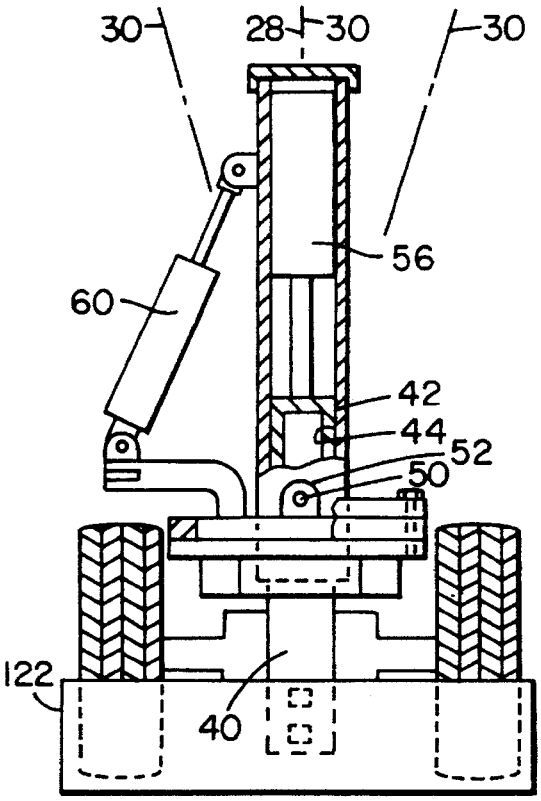
Fig. 4
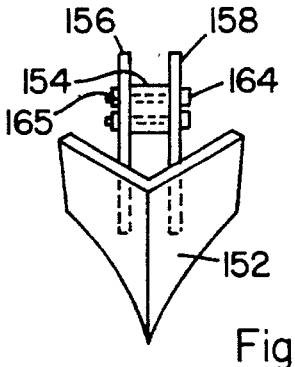
Fig. 10
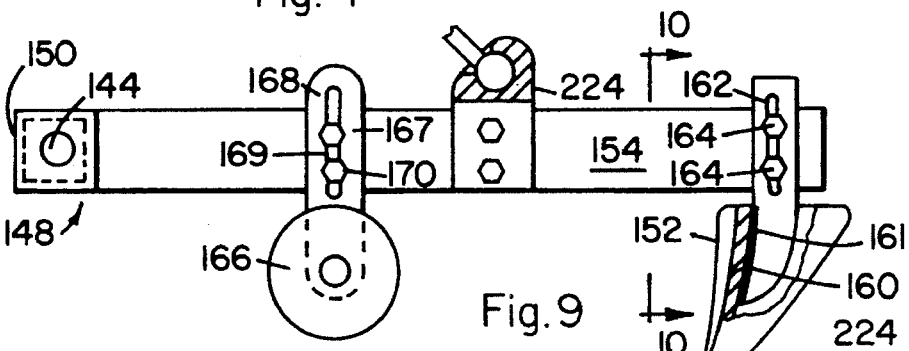
Fig. 9
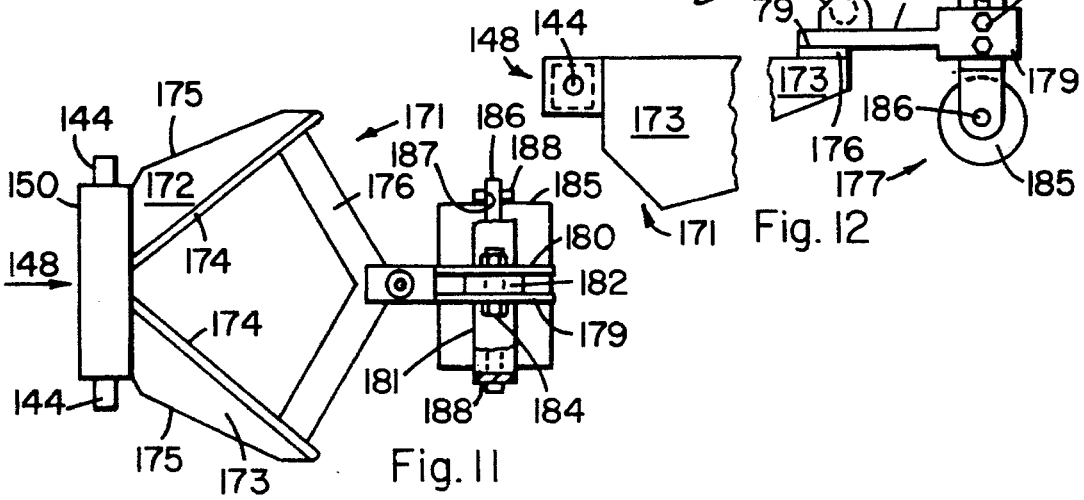
Fig. 11
Fig. 12

ARTICULATED VEHICLE FOR USE IN CONFINING TRENCH WORK

This invention concerns a tractor-like, wheeled vehicle which is especially constructed to operate within a relatively narrow space such as down within the ditch of a household septic field line where presently available earth moving equipment is not adapted to move about and perform trenching or other material moving operations.

In the construction of septic field lines, it is conventional to first dig a trench about two or three feet deep and about three feet wide in the front or back yard of a home or other building. This trench is dug typically by a back-hoe or similar equipment which straddles the trench as the bucket or other digging implement does its work. The dimensions of this trench, depending on the usage burden projected for the field line can be adjusted to meet the need, but, typically is of the approximate cross-section mentioned above, however, the total length of the line, the number of substantially parallel runs, and the tightness of the turns connecting adjacent runs can be varied to accommodate the projected burden as well as the terrain characteristics.

The second operation is to partially fill the trench with crushed stone or similar material, typically to a depth of from about one to about one and a half feet of said material and then to level it out substantially uniformly throughout the entire field line. The third operation is then to dig a trough down the center of the material, preferably in the form of a V such that the apertured drain line pipe can be layed into the trough and substantially centered therein. The fourth operation is then to cover over the pipe to a depth of, for example, about 1—3 inches with the material which was displaced during forming of the trough. The last operation is complete filling of the trench with the earth removed during digging of the trench.

Heretofore, many materials moving vehicles for performing special tasks in special ways have been developed, including those shown in U.S. Pat. Nos.: 4,050,535; 5,222,574; 3,437,163; 4,914,840; 4,825,569; 4,428,132; 3,662,848; and 3,282,367, the disclosures of which are hereby incorporated herein by reference, particularly with respect to the well known structural elements and features thereof, especially the articulated body or frame structures and such as the swivel or pivot means connecting the body sections, the four wheel drive trains, and the universal joints in the drive trains such as described in the above recited U.S. Pat. Nos. 4,050,535 and 5,222,574.

Most of these prior vehicles have been especially designed for carrying out certain materials moving functions, however, none of them are so constructed as to be able to operate within the confines of a typical field line trench so as to level the crushed stone or other such material, to then dig an accurately dimensioned and continuous pipe trough therein, including around the turns of the trench, and then to cover over the field line pipe layed within the trough with the same material which originally occupied the trough area, all said operations being carried out in a fraction of the time normally required by back-hoe, hand, or other means typically employed in constructing such field lines. It is particularly noted, that heretofore, considerable hand labor has been required to properly level the material prior to forming the trough, to then dig the trough to proper and uniform dimensions, and then to replace the removed material to a level and uniform depth over the pipe positioned in the trough. Performing these operations is not within the province of the vehicles disclosed in the prior art.

Objects, therefore, of the present invention are: to provide a tractor-like vehicle which is capable of performing the above operations typically involved in the construction of septic field lines or the like; to provide such a vehicle adapted for quick and easy attachment thereto of various material moving implements; to provide unique and highly effective material moving implements specially adapted for mounting on said vehicle; and to provide such vehicle and implements with unique structure and appropriate dimensions such that the vehicle can operate down in the field line trench and not have to operate from a position on the ground outside of and above the trench.

These and other objects herein appearing have been attained in accordance with the present invention which, in its broad context is defined as a powered vehicle for preparing a trough for a field line drain pipe in crushed stone or similar material layed in a previously dug field line trench, and for the covering over a drain pipe positioned in the trough with the material previously displaced therefrom, said vehicle comprising (a) body means having a rear section and a front section, (b) swivel means connecting said sections together and providing for pivoting of said sections relative to each other in a substantially horizontal plane, (c) wheel means on each of said sections, (d) motor means on said body means and transmission means connected to said motor means and to said wheel means for driving the same selectively in a forward or rearward direction, (e) implement supporting means comprising stanchion means having a vertical position axis and a longitudinal axis, (f) cooperating pivot means on said stanchion means and on an outer end portion of at least one of said rear or front sections, said pivot means allowing said stanchion means to be maintained in a generally upright posture on said section while providing angular adjustability to said stanchion means, said adjustability comprising individual rotational and tilting paths of motion with respect to said vertical position axis, (g) said stanchion means further comprising work shaft means to which any of said implements can be affixed, and cooperating elements of first bearing means on said work shaft means and on said stanchion means for allowing said work shaft means to move substantially longitudinally of said stanchion means in a generally up or down direction to provide a parallel path of motion with respect to said longitudinal axis for any implement affixed to said shaft means, said first bearing means directing said shaft means and any implement affixed thereto to move coincidentally with said stanchion means through each of said rotational or tilting paths of motion, (h) said pivot means comprising stationary race means on said outer end portion of said rear or front section, and armature means on said stanchion means and rotationally retained by said race means for allowing said rotational path of motion, said pivot means further comprising cooperating elements of second bearing means on said stanchion means and on said armature means and providing to said second bearing means a pivot axis oriented substantially normal to said vertical position axis for allowing said tilting path of motion, (i) first power means engaging said work shaft means for selectively moving the same in said generally up or down direction for providing said parallel path of motion, second power means engaging said stanchion means for selectively rotating the same in either direction about said vertical position axis to provide said rotational path of motion, and third power means engaging said stanchion means for selectively rotating the same in either direction about said pivot axis of said second bearing means to provide said tilting path of motion, (j) coupling means on said work shaft means for removably affixing an implement thereto, and (k) individual control means on said vehicle for selectively actuating each of said power means.

The invention will be further understood from the following drawings and description thereof, wherein;

FIG. 4 is a front view of the present vehicle;

FIG. 9 is a side view, partially in section, of a troughing plow;

FIG. 10 is a view taken along line 10—10 of FIG. 9 in the direction of the arrow;

FIG. 11 is a top view of a plow type trough filling implement;

FIG. 12 is a side view of the implement of FIG. 11;

Figures 1, 2, 5, 6, 7, 8:
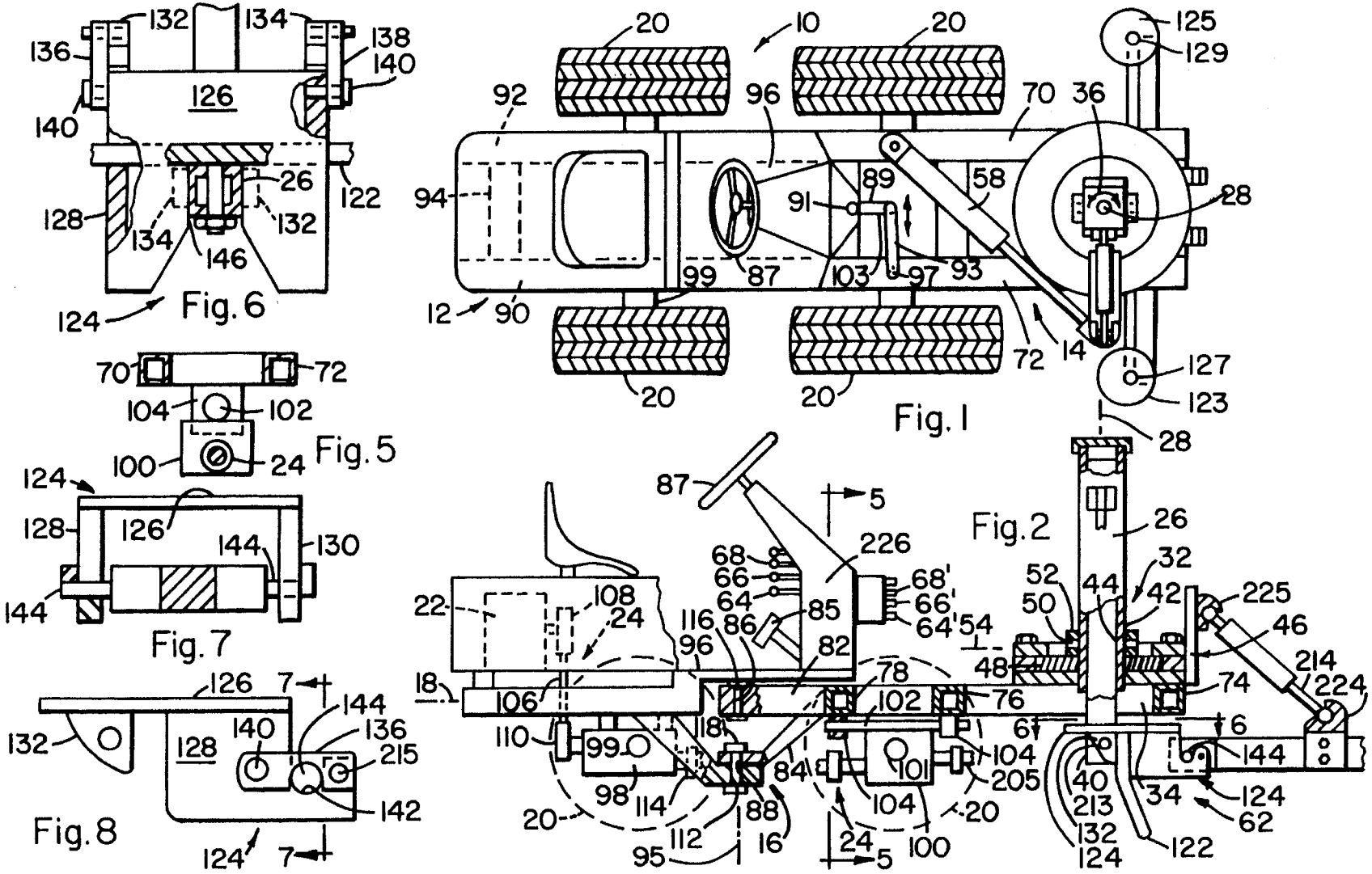
FIG. 1 is a top elevational view of the present vehicle.
FIG. 2 is a side elevational view of the present vehicle.
FIG. 5 is a cross-sectional view taken along line 5—5 of FIG. 2 in the direction of the arrows.
FIG. 6 is a cross-sectional view taken along line 6—6 of FIG. 2 in the direction of the arrows.
FIG. 7 is a partially cross-sectional view taken along line 7—7 of FIG. 8 in the direction of the arrows.
FIG. 8 is a side view of the coupling adaptor of FIG. 6 taken in the direction of arrow 8.

Referring to the drawings and with reference to the claims hereof, the present vehicle comprises (a) body means 10 having a rear section 12 and a front section 14, (b) swivel means 16 connecting said sections together and providing for pivoting of said sections relative to each other in a substantially horizontal plane 18, (c) wheel means 20 on each of said sections, (d) motor means 22 on said body means and drive train means 24 connected to said motor means and to said wheel means for driving the same selectively in a forward or rearward direction, (e) implement supporting means comprising stanchion means 26 having a vertical position axis 28 and a longitudinal axis 30, (f) cooperating pivot means 32 on said stanchion means and on an outer end portion 34 of at least one of said rear or front sections, said pivot means allowing said stanchion means to be maintained in a generally upright posture on said section as shown in FIG. 1, while providing angular adjustability to said stanchion means, said adjustability comprising individual rotational 36 and tilting 30 paths of motion with respect to said vertical position axis 28 as shown in FIGS. 1 and 4 respectively, (g) said stanchion means further comprising work shaft means 40 to which any of said implements can be affixed, and cooperating elements 42, 44 of first bearing means on said shaft means and on said stanchion means for allowing said shaft means to move substantially longitudinally of said stanchion means in a generally up or down direction to provide a parallel path of motion with respect to said longitudinal axis for any implement affixed to said shaft means, said first bearing means directing said shaft means and any implement affixed thereto to move coincidentally with said stanchion means through each of said rotational or tilting paths of motion, (h) said pivot means comprising stationary race means 46 on said outer end portion 34 of said rear or front section, and armature means 48 on said stanchion means and rotationally retained by said race means for allowing said rotational path of motion, said pivot means further comprising cooperating elements 50, 52 of second bearing means on said stanchion means and on said armature means and providing to said second bearing means a pivot axis 54 oriented substantially normal to said vertical position axis for allowing said tilting path of motion, (i) first power means 56 engaging said shaft means for selectively moving the same in said generally up or down direction for providing said parallel path of motion, second power means 58 engaging said stanchion means for selectively rotating the same in either direction about said vertical position axis to provide said rotational path of motion, and third power means 60 engaging said stanchion means for selectively rotating the same in either direction about said pivot axis 54 of said second bearing means to provide said tilting path of motion, (j) coupling means 62 on said shaft means for removably affixing an implement thereto, and (k) individual control means 64, 66, 68 on said vehicle for selectively actuating each of said first, second and third power means.

The body means sections 12 and 14 are basically similar to the front and rear sections of the articulated frame vehicles shown in the aforesaid U.S. patents. The present front section 14 preferably comprises parallel, longitudinal frame members 70, 72, cross members 74, 76, 78, and pivot end portion 80 having upper and lower segments 82, 84 respectively, all of which can be constructed, e.g., of tubular or channel steel. The number of cross members and their positions may be varied, and, if desired, the front section may be constructed of thick sheet steel. Each of segments 82 and 84 is apertured to provide swivel bearings 86 and 88 respectively.

The frame construction of the rear section 12 is basically the same as the front section and is comprised of parallel, longitudinal frame members 90, 92, and a suitable number and placement of cross members such as 94 for supporting the various components of the power means 22 and the like located in the rear section. The forward portion of the rear section, preferably welded to members 90, 92, provides a floor board 96 for the operator and for supporting the gas pedal, brakes, and clutch, e.g., as 85, all in conventional manner. In this regard, it is preferred to have two brake pedals such that the braking systems, preferably hydraulic, operated thereby can selectively brake both wheels on one side of the vehicle such that sharper turns can be made.

The rear wheels are driven by transmission 98 and axles 99 and the front wheels by transmission 100 and axles 101, which, transmission preferably is pivotally mounted on the frame by shaft 102 fixed to the transmission and pivotally mounted in bearings 104 fixed to the underside of the frame. This arrangement allows the front wheels to more easily follow the contour of the work surface while maintaining the vehicle in a more level posture for accurately preparing the pipe trough.

The drive shafts and universal joints connecting the transmissions and motor are of conventional construction and equivalent in operation to the shown in said U.S. Pat. No. 5,222,574. It is noted that in a preferred form of the present vehicle, each transmission is selectively operable by clutch means, however, the front transmission is driven by the rear transmission which is powered by internal combustion engine 22 and chain or belt 106 mounted on suitable sprockets or pulleys 108 and 110 in conventional manner.

The swivel means 16 connecting the front and rear sections comprises bearings 86 and 88 provided on frame segments 82 and 84 respectively, bearing 112 in lower segment 114 of the rear frame, upper swivel pin 116 welded to the underside of floor board 96, and lower swivel pin 118. The swivel axes 120 of the pins are, of course, in alignment. In steering the vehicle, rotation of steering wheel 87, e.g., counterclockwise in FIG. 1, will swing steering arm 89 counterclockwise about pivot point 91 and drag the link 93 to the left and thus rotate the front body section about the swivel axis 95 in a counterclockwise direction, link 93 being pivotally connected at 97 to the forward section frame and at 103 to steering arm 89.

The coupling means 62, in a preferred embodiment shown in the drawings, comprises blade 122 which is affixed in any suitable manner to work shaft means 40, either removably or permanently, and adapter plate 124 shown in detail in FIGS. 6, 7 and 8. The adaptor plate comprises a substantially flat top 126 having welded thereto depending flanges 128, 130 and depending segments 132, 134, and lock-down arms 136, 138 pivotally mounted on said flanges by bolts or equivalent means 140. The flanges are provided with recesses 142 for receiving the projections 144 of the implement being employed for a particular operation. Slot means 146 is formed into top 126 for slidably receiving stanchion 26.

It is noted that blade 122, in the preferred embodiment shown in the drawings, is in the general configuration of a dozen blade and preferably is dimensioned approximately thirty three inches in length, which is slightly more, e.g., 2–4 inches, than the width of the vehicle sections as measured to the outside of wheels 20. A pair of outboard wheels 123, 125, preferably of resilient rubber-like material, are rotatably mounted on the ends of blade 122 by pins 127, 129 respectively welded vertically at their ends to the top of said blade and extend slightly beyond, e.g., 1–2 inches, the ends of said blade and function to prevent digging of the blade ends into the sides of the trench during maneuvering of the vehicle within the confines of the trench. Typically such a field line trench is approximately three feet in width and the blade 122 can be used to level the granular fill material in preparation for digging the pipe trough therein. In the embodiment of FIG. 1 and related figures, the blade doubles as a dozer blade and as part of the coupling means for removably attaching the implement to the work shaft. It is particularly noted a very important aspect of a most preferred embodiment of the present invention is that the widest part of the vehicle must be less than about three feet, especially between 2.5 and 3.0 feet such that it can function within the confines of conventional septic field line trenches.

The various implements and their shapes which may be used with the present vehicle can be widely varied and useful, exemplary types of trough forming plows and trough filling devices are shown in FIGS. 10–14. Each of these implements utilizes the same type of coupling element 148 such that the implement can be quickly and easily attached to and removed from the adaptor plate 124. This coupling element comprises bar 150 having the aforesaid projections 144 extending from each end thereof and adapted to nest in recesses 142 in flanges 128, 130 and be locked therein by lock-down arms 136, 138.

As shown in FIGS. 9 and 10, a troughing plow implement 152 is mounted on shaft means 154 by connector plates 156, 158 which are welded to the rear side 160 of the plow at 161. These plates are preferably slotted at 162 such that they can be adjusted up or down on bolts 164 before the bolt nuts 165 are tightened. Shaft means 154 is welded to mounting bar 150 and is further provided with a wheel 166 attached thereto by connector plates 167, 168 slotted at 169 for up or down adjustability and fixed in position on the shaft means by bolts 170.

As shown in FIGS. 11 and 12, a trough filling plow or implement generally designated 171 comprises mounting bar 150, diverging blades 172, 173, preferably which are slanted outwardly from top 174 to bottom 175, stabilizing member 176 welded at its ends to said blades, and roller assembly generally designated 177 affixed to said member 176 by welding, bolts, or the like at 79. The roller assembly comprises extension plate means 178, side plates 179, 180, clevis means 181 provided with adjustable support post 182 provided with adjustment slot 183 and slidably mounted between said side plates and adapted to be fixed in its adjusted position therebetween by bolts 184 or the like, and roller means 185 rotatably mounted on shaft means 186 mounted in apertures 187 in end flanges 188 of clevis 181.

Figure 13:
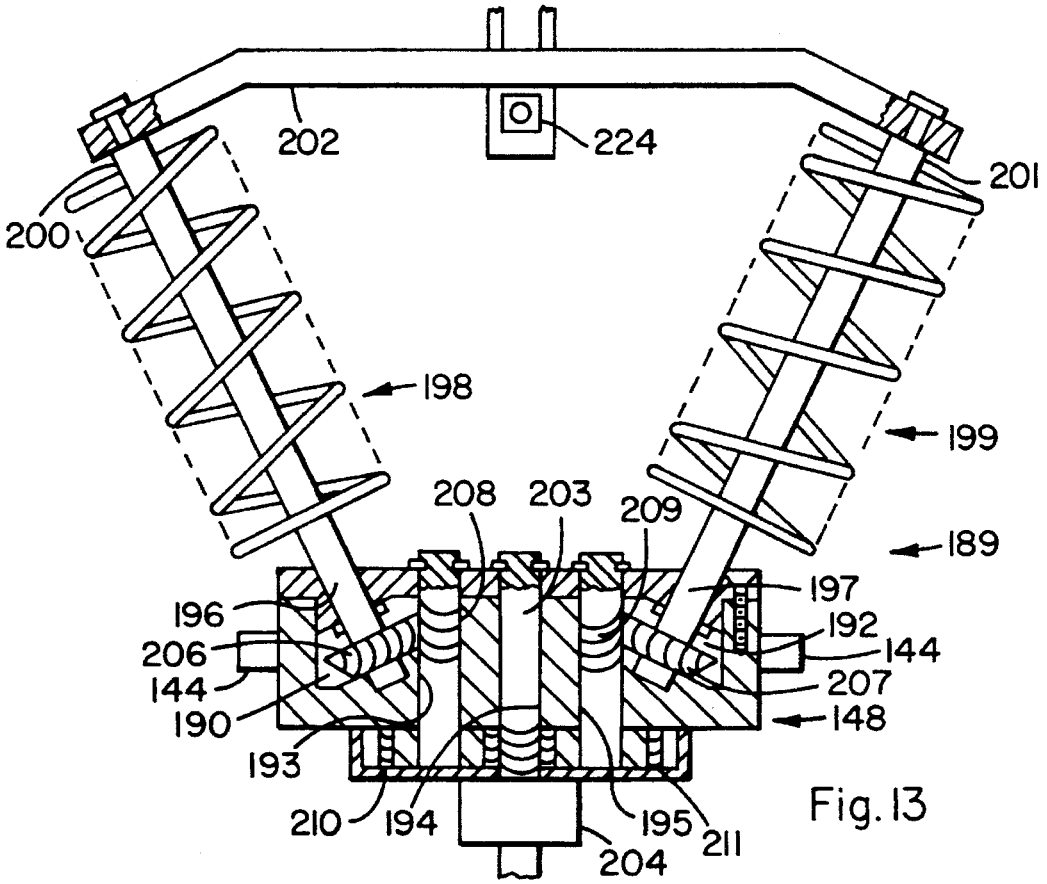
FIG. 13 is a partially sectioned top view of a screw type trough filling implement.
Figure 3:
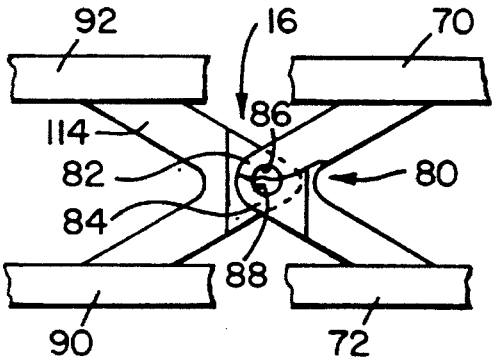
FIG. 3 is an elevational top view of lower portions of the vehicle body section frames showing the position of the swivel means connecting the body sections.

Referring to FIG. 13, a screw type of trough filling implement generally designated 189 is shown and comprises a modified form of coupling element 148 wherein suitable worm gear cavities 190, 192 and suitable worm shaft bearing apertures 193, 194, 195 are provided for accommodating the driven ends 196, 197 of the shafts of a pair of material moving screws 198, 199. The outer ends 200, 201 of the screw shafts are journaled in stabilizing bar means 202 hereinafter further described. These screws are in the general shape of material conveying screws such as shown in U.S. Pat. Nos. 3,934,363 and 4,283,867, the disclosures of which with respect to the screws and their rotational mounting structures are hereby incorporated herein by reference. These screws may be driven, e.g., by the means shown in FIG. 13 wherein the center worm shaft means 203 is provided with a universal joint 204 which is provided with quick connection means for connection to a power take-off 205 provided on the front transmission 100 of the vehicle. The beveled worm gears 206, 207 are driven by worm shaft means 208, 209 which, in turn, are driven respectively through worm gears 210, 211 affixed thereto and meshing with center worm shaft means 203. This type of gear drive mechanism is exemplary only and alternatively, e.g., can constitute a hydraulic drive system as is well known in the art.

Figure 14:
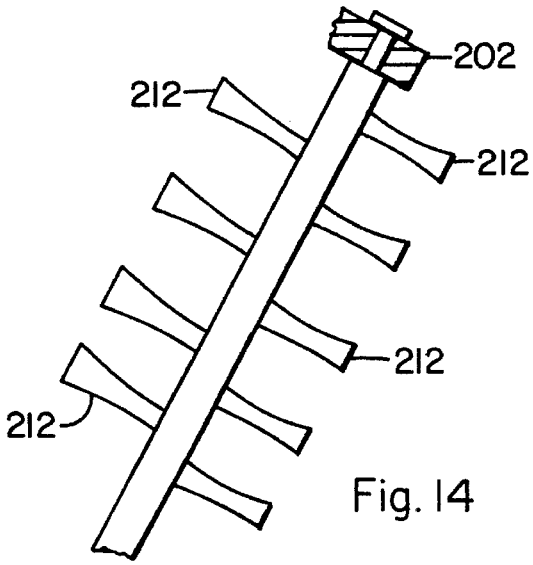
FIG. 14 is a partially sectioned view of the work portion of tilling type of trough filling implement for use with the worm power gearing of FIG. 13.
Figure 15:
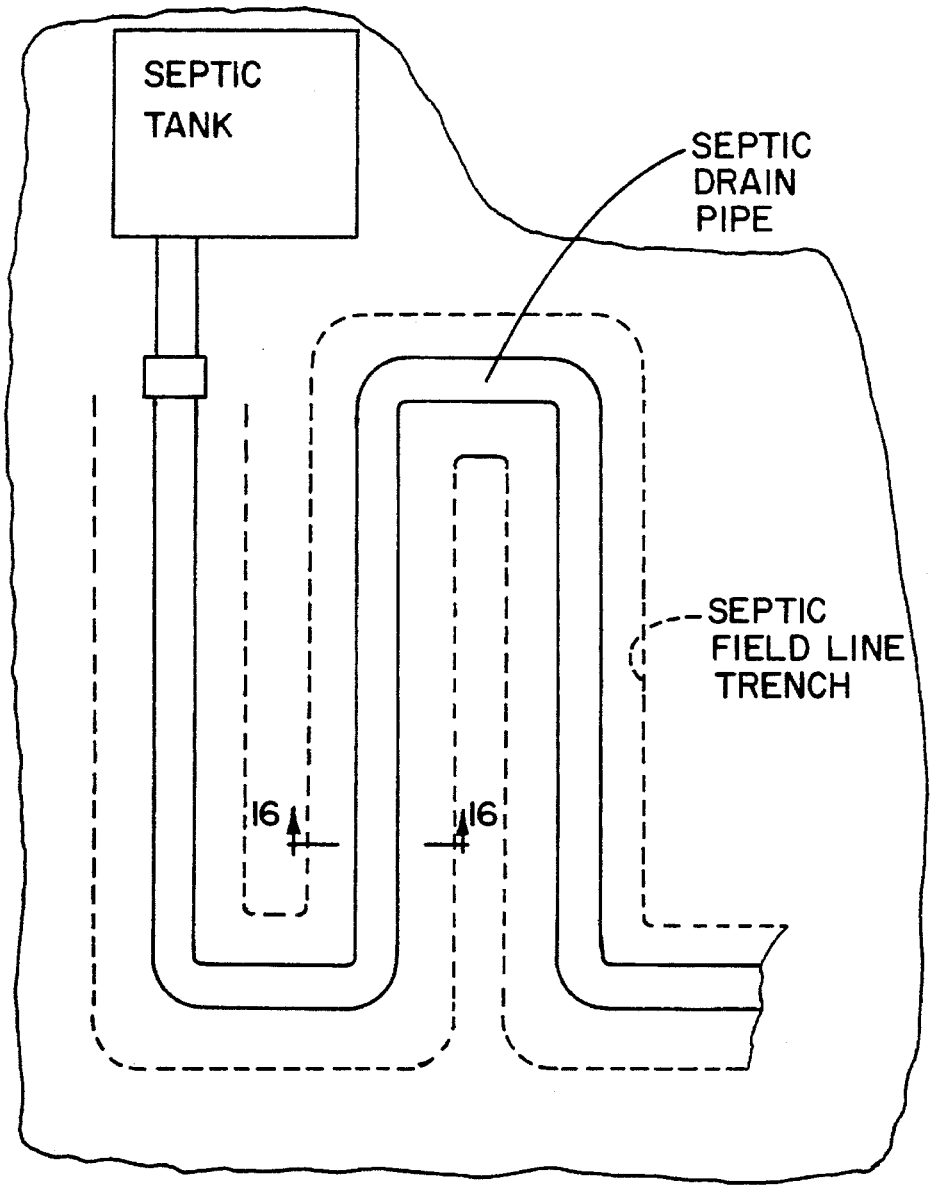
FIG. 15 is a schematic of a typical septic field line layout.
Figure 16:
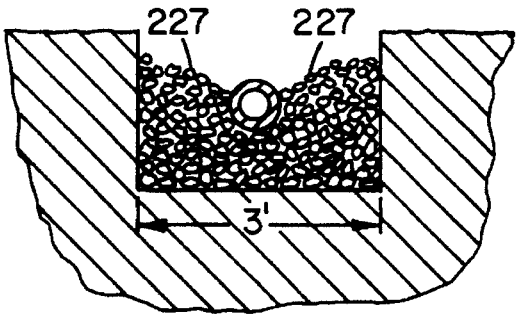
FIG. 16 is a cross-sectional view of the field line taken along line 16—16 of FIG. 15 in the direction of the arrows.

Referring to FIG. 14, the screws of FIG. 13 are replaced by individual tilling tines 212 of any suitable configuration including straight or contoured as in roto-tillers.

Figure 20:
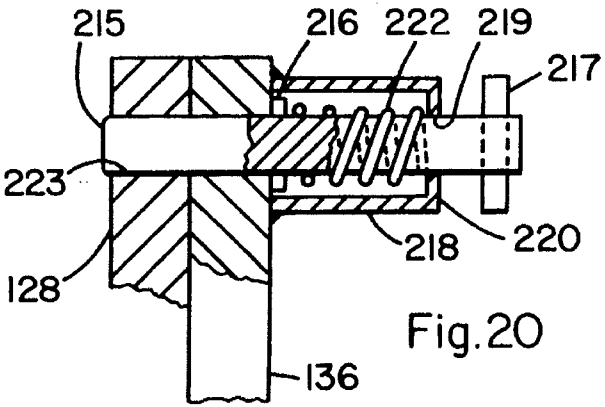
FIG. 20 is a cross-sectional view of a locking pin construction for holding the implement onto the adaptor plate.

In the operation of the present vehicle, the adaptor plate 124 is positioned on the work shaft 40 by moving the adaptor plate over the blade 122 while nesting said work shaft within slot means 146 until segments 132, 134 fall behind the blade as shown in FIGS. 2 and 6. At this point a lock pin 213 may be inserted through aligned apertures in said segments and said work shaft, however, such locking is not always necessary since the weight of the implement alone, or as enhanced by the hold-down of hydraulic piston 214, i.e., the fourth power mean will suffice to prevent upward dislocation of the adaptor plate from said blade and work shaft during material moving operations of the vehicle. The type of implement to be employed is then selected and the projections 144 of its coupling element 148 are positioned in recesses 142. The lock-down arms 136, 138 are then pivoted about their mounting bolts 140 and over the tops of said projections 144 and locked in position thereover by locking pins 215. These pins are preferably of a spring urged construction such as shown in FIG. 20 with reference to lock-down arm 136, wherein each pin 215 is provided with a flange 216 and handle means 217. A pin housing 218, preferably a closed cylinder, is welded to arm 136 and slidably receives the pin 215 through aperture 219 in end 220 of the cylinder. A compression spring 222 compressed between flange 216 and end 220 provides the automatic force to push the pin through a lock orifice 223 in flange 128 when the hand generated pin retracting force of the operator is removed from handle means 217.

With, for example, the plow 152 thus affixed to the vehicle, the plow itself and/or the depth controller, i.e., the up or down position of wheel 166 is adjusted to control the depth of the trough being dug by the plow of FIGS. 9 and 10 as it is moved through the field line fill material, i.e., to the left in FIG. 9. In this regard, hold-down piston 214 which is attached to the implement, preferably by ball and socket means 224 and to the vehicle front by ball and socket means 225, may be used to assist in maintaining a desired up or down position of the plow, as well as for retracting the implement to an up, neutral position whereby the vehicle can be readily moved about without interference of the implement with the ground area. The ball and socket mounting of piston 214 is necessary for accommodating the various rotative or tilting movements of the implement. Piston 214 is also connected into a hydraulic operating system which the operator can manually control by suitable lever means mounted on the dash board 226 of the vehicle, all in known manner.

In regard to the trough filling implement or plow of FIGS. 11 and 12, the roller 185, preferably of flexible, elastomeric material, is adapted to roll on top of the field line pipe which typically is of plastic material, and the plow portions 172, 173 thereof pushed into the fill material, to the right in FIGS. 11 and 12, which causes the plow to force the material 227 which was piled up on the sides of the trench by the troughing plow, inwardly and over the top of the pipe to a desired depth. In this regard, the blades 172, 173 are shaped and dimensioned such that the bottom edges 175 thereof, as shown in FIG. 12, will dig down into the 227 material sufficiently to displace a sufficient amount thereof to cover over the pipe to the desired depth, e.g., about 2–6 inches.

The trough filling implements of FIGS. 13 and 14 preferably are provided with roller means such as 185 and the screws or tines thereof are mounted to rotate in an inward direction so as to force the material inwardly and over the field line pipe.

Figure 19:
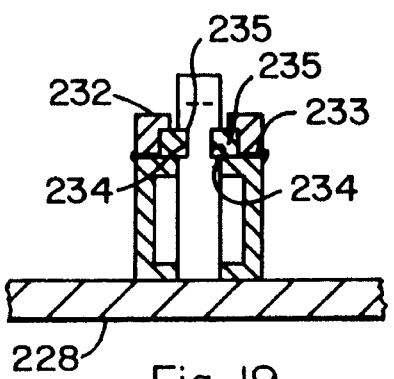
FIG. 19 is a cross-sectional view taken along line 19—19 of FIG. 18 in the direction of the arrows.
Figure 18:
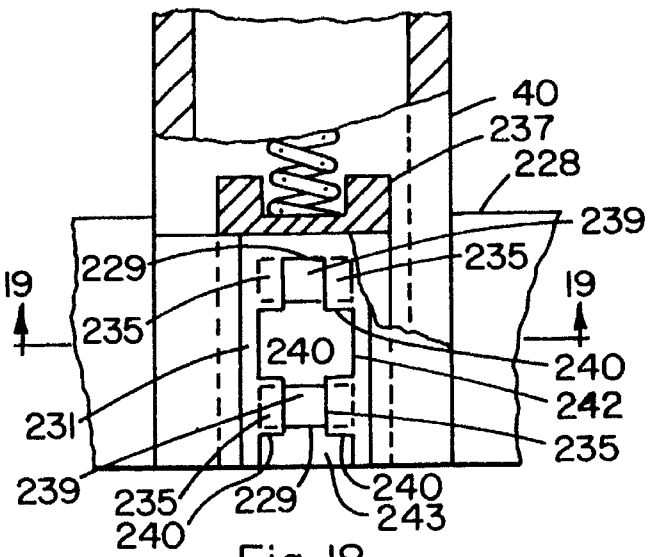
FIG. 18 is a view, partially sectioned, taken along line 18—18 of FIG. 17 in the direction of the arrows.
Figure 17:
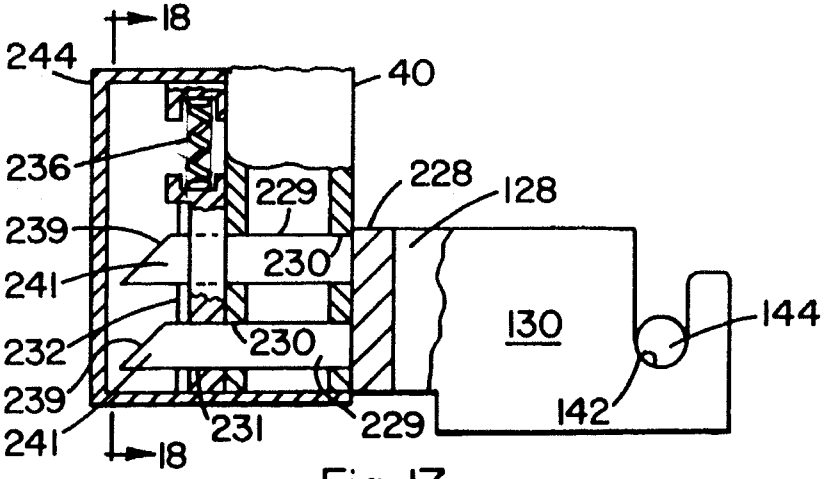
FIG. 17 is a side view, partially sectioned, of a variation in the quick coupling means for removably affixing the implement to the work shaft.

Shown in FIGS. 17–19 is a variation of the quick coupling means for removably affixing an implement to the work shaft means 40. In this variation the coupling means 62, i.e., item (J) of claim 1, comprises the cooperating structures of flanges 128, 130, a mounting segment 228 such as blade 122 or a shorter segement, e.g., a segment of sufficient length to support flanges 128, 130 at the proper spacing to accommodate the coupling element 148, one or more latch bolts 229 fixed to segment 228, apertures 230 through the work shaft 40, a latching slide 231, and a slide race 232 affixed to the rear side 233 of work shaft 40. The latch bolts are preferably rectangular in cross-section and are slotted on each side at 234 to receive the locking projections 235 of slide 231 as the slide is slid downwardly within its race 232 for locking the latch bolts firmly to work shaft 40. A suitably heavy compression spring 236 compressively mounted between the top 237 of slide 231 and a spring retaining block 238 fixed to the rear side of work shaft 40 provides a continuous downward force to the slide to insure attaining its locking position shown in FIG. 18. This portion is attained after the cam surfaces 239 of bolts 229 have engaged shoulders 240 of the slide, have moved the slide to an upper position wherein the ends 241 of the latch bolts are positioned within the neutral cavities 242, 243 of the slide, and after further inward forcing of the bolts, i.e., to the left in FIG. 17, whereby the slots 234 in the sides of the bolts become aligned with the locking projections 235 such that the slide can be forced downwardly by spring 236. The slide, and thus its locking function, is removed from its locking position by hand forcing the slide upwardly while urging segment 228 to the right in FIG. 17. A snap-on dust shield such as 244 may be provided to protect the more fragile coupling structures.

In the digging of the trough as well as in the filling operations, the several paths of motion of the implement, i.e., the generally side ways motion thereof caused by rotation of the stanchion means 26 about its longitudinal axis, the generally up or down motion caused by such motion of work shaft 40, the tilting motion caused by tilting of the stanchion means to either side of the vertical position axis 28, the directive motion of the articulated body, and the generally vertical arcing motion of the implement through its generally longitudinal plane by the action of piston 214 all came into play during the digging and filling operations.

The invention has been described in detail with particular reference to preferred embodiments thereof, but it will be understood that variations and modifications will be effected within the spirit and scope of the invention.

I claim:

1. A powered vehicle for preparing a trough in crushed stone of similar material layed in a trench, and for covering over a drain pipe positioned in the trough with the material previously displaced therefrom, said vehicle comprising (a) body means having a rear section and a front section, (b) swivel means connecting said sections together and providing a swivel axis on which pivoting of said sections relative to each other in a substantially horizontal plan occurs, (c) wheel means on each of said sections, (d) motor means on said body means and transmission means connected to said motor means and to said wheel means for driving said wheel means selectively in a forward or rearward direction, (e) implement means supporting means comprising stanchion means having a vertical position axis and a longitudinal axis, (f) cooperating pivot means on said stanchion means and on an outer end portion of said front section, said pivot means allowing said stanchion means to be maintained in a generally upright posture on said front section while providing angular adjustability to said stanchion means, said adjustability comprising individual rotational and tilting paths of motion with respect to said vertical position axis, (g) said stanchion means further comprising work shaft means to which an implement means can be affixed, and cooperating elements of first bearing means on said work shaft means and on said stanchion means for allowing said work shaft means to move substantially longitudinally of said stanchion means in a generally up or down direction to provide a parallel path of motion with respect to said longitudinal axis for an implement means affixed to said work shaft means, said first bearing means being adapted to direct said shaft means and an implement means affixed thereto to move coincidentally with said stanchion means through each of said rotational and tilting paths of motion, (h) said pivot means comprising stationary race means on said outer end portion of said rear or front section, and armature means on said stanchion means and rotationally retained by said race means for allowing said rotational path of motion, said pivot means further comprising cooperating elements of second bearing means on said stanchion means and on said armature means and providing to said second bearing means a pivot axis oriented substantially normal to said vertical position axis for allowing said tilting path of motion, (i) first power means engaging said work shaft means for selectively moving the same in said generally up or down direction for providing said parallel path of motion, second power means engaging said stanchion means for selectively rotating the same in either direction about said vertical position axis to provide said rotational path of motion, and third power means engaging said stanchion means for selectively rotating the same in either direction about said pivot axis of said second bearing means to provide said tilting path of motion, (j) coupling means on said work shaft means for removably affixing an implement means thereto, and (k) individual control means on said vehicle for selectively actuating each of said first, second and third power means.

2. The vehicle of claim 1 wherein said wheel means comprises one wheel on each side of each of said sections, said transmission means comprises a rear transmission and axle means for simultaneously driving the wheels of said rear section, and a front transmission and axle means for simultaneously driving the wheels of said front section, said rear transmission being fixedly attached to said rear section and said front transmission and axle means being pivotally mounted on said front section on an arc axis oriented longitudinally of said front section such that said front transmission, front axle means and front wheels can rotate through an arc around said arc axis.

3. The vehicle of claim 2 wherein said coupling means and cooperating structure on an implement means provided on said vehicle allows said implement means to pivot on said coupling means in a generally up and down arcuate manner, and fourth power means connected to said vehicle and to said implement means for moving said implement means in said arcuate manner.

4. The vehicle claim 1 wherein an implement means is provided on said vehicle and is selected from dozer type blade means, troughing plow means, and trough filling plow means.

5. The vehicle of claim 1 wherein said coupling means comprises aperture means formed laterally through said work shaft means, one end of rod means being affixed to an implement means and having shoulder means adjacent its other end, said aperture means, rod means and work shaft means being dimensioned such that said rod means is insertable through said aperture means with said shoulder means being spaced laterally outwardly from said work shaft means, and locking plate means slidably mounted on said work shaft means and movable from a non-locking position to a locking position between said shoulder means and said work shaft means for preventing withdrawal of said rod means and displacement of said implement means from said work shaft means.

6. The vehicle of claim 5 wherein said locking plate means is spring urged toward said locking position.

7. The vehicle of claim 6 wherein said rod means and locking plate means have cooperating cam surface means which, as said rod means is being inserted through said aperture means, contact each other and cause said locking plate means to be cammed from said locking position to said non-locking position, and then as said shoulder means moves into its locking position, allowing said locking plate means to snap into its locking position behind said shoulder means.

8. The vehicle of claim 1 wherein said control means is adapted to actuate, simultaneously, two or more of said first, second and third power means to move an implement means provided on said vehicle through a complex path of motion.

9. The vehicle of claim 1 wherein a dozer blade is provided on said vehicle and wherein the widest portion of said vehicle is between 2.5 and 3.0 feet, wherein the length of the front section, from said dozer blade to said swivel axis is no greater than 60 inches, and wherein the length of the rear section, from back to said swivel axis is no greater than 60 inches.

* * * * *